US006499489B1

(12) United States Patent
Coleman, III

(10) Patent No.: US 6,499,489 B1
(45) Date of Patent: Dec. 31, 2002

(54) TOBACCO-BASED COOKED CASING FORMULATION

(75) Inventor: William Monroe Coleman, III, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 09/569,769

(22) Filed: May 12, 2000

(51) Int. Cl.[7] ..... A24B 15/18; A24B 15/26; A24B 15/28

(52) U.S. Cl. ..... 131/309; 131/310; 131/276; 131/300; 131/308; 131/297

(58) Field of Search ..... 131/275, 276, 131/297, 298, 300, 308, 307, 310

(56) References Cited

U.S. PATENT DOCUMENTS

| | | | | |
|---|---|---|---|---|
| 3,316,919 | A | | 5/1967 | Green et al. |
| 3,424,171 | A | | 1/1969 | Rooker |
| 3,478,015 | A | | 11/1969 | Onishi et al. |
| 3,722,516 | A | | 3/1973 | Suwa et al. |
| 3,760,815 | A | | 9/1973 | Deszyck |
| 3,828,798 | A | | 8/1974 | Harper et al. |
| 3,920,026 | A | | 11/1975 | Warfield et al. |
| 3,929,141 | A | | 12/1975 | Beringer et al. |
| 3,934,594 | A | | 1/1976 | Beringer et al. |
| 4,040,431 | A | | 8/1977 | Ashworth et al. |
| 4,079,742 | A | | 3/1978 | Rainer et al. |
| 4,150,677 | A | | 4/1979 | Osborne, Jr. et al. |
| 4,184,495 | A | | 1/1980 | Rainer et al. |
| 4,286,606 | A | | 9/1981 | Swain et al. |
| 4,306,577 | A | | 12/1981 | Wu et al. |
| 4,379,464 | A | * | 4/1983 | Wu et al. ..... 131/275 |
| 4,407,307 | A | | 10/1983 | Gaisch et al. |
| 4,421,126 | A | | 12/1983 | Gellatly |
| 4,481,956 | A | | 11/1984 | Chan |
| 4,506,682 | A | | 3/1985 | Muller |
| 4,516,590 | A | | 5/1985 | Teng |
| 4,537,204 | A | | 8/1985 | Gaisch et al. |
| 4,538,627 | A | | 9/1985 | Chan et al. |
| 4,566,468 | A | | 1/1986 | Sachleben et al. |
| RE32,095 | E | | 3/1986 | Wu et al. |
| 4,596,259 | A | | 6/1986 | White et al. |
| 4,605,016 | A | | 8/1986 | Soga et al. |
| 4,607,646 | A | | 8/1986 | Lilly, Jr. et al. |
| 4,628,947 | A | | 12/1986 | Driscoll et al. |
| 4,638,816 | A | | 1/1987 | Cox et al. |
| 4,674,519 | A | | 6/1987 | Keritsis et al. |
| 4,677,994 | A | | 7/1987 | Denier et al. |
| 4,701,282 | A | | 10/1987 | Chan et al. |
| 4,715,388 | A | | 12/1987 | Rainer |
| 4,744,375 | A | | 5/1988 | Denier et al. |
| 4,760,854 | A | | 8/1988 | Jewell et al. |
| 4,827,949 | A | | 5/1989 | Sunas |
| 4,941,484 | A | | 7/1990 | Clapp et al. |
| 4,986,286 | A | | 1/1991 | Roberts et al. |
| 5,016,654 | A | | 5/1991 | Bernasek et al. |
| 5,018,540 | A | | 5/1991 | Grubbs et al. |
| 5,038,802 | A | | 8/1991 | White et al. |
| 5,060,663 | A | | 10/1991 | Rainer |
| 5,060,669 | A | | 10/1991 | White et al. |
| 5,065,775 | A | | 11/1991 | Fagg |
| 5,074,319 | A | | 12/1991 | White et al. |
| 5,099,862 | A | | 3/1992 | White et al. |
| 5,121,757 | A | | 6/1992 | White et al. |
| 5,131,415 | A | | 7/1992 | Munoz et al. |
| 5,159,942 | A | | 11/1992 | Brinkley et al. |
| 5,234,008 | A | | 8/1993 | Fagg |
| 5,235,992 | A | | 8/1993 | Sensabaugh, Jr. |
| 5,284,166 | A | | 2/1994 | Cartwright et al. |
| 5,318,050 | A | | 6/1994 | Gonzalez-Parra et al. |
| 5,339,838 | A | | 8/1994 | Young et al. |
| 5,413,122 | A | | 5/1995 | Shu et al. |
| 5,598,868 | A | | 2/1997 | Jakob et al. |
| 5,962,662 | A | * | 10/1999 | Shu et al. ..... 536/18.7 |
| 6,048,404 | A | | 4/2000 | White |

FOREIGN PATENT DOCUMENTS

| | | |
|---|---|---|
| DE | 1 517 280 | 9/1969 |
| EP | 0 110 693 A1 | 6/1984 |
| EP | 0 517 407 A2 | 12/1992 |
| EP | 0 821 886 A2 | 2/1998 |
| FR | 2 767 649 A1 | 3/1999 |
| GB | 572236 | 9/1945 |
| GB | 1383029 | 2/1975 |
| GB | 2 239 654 A | 7/1991 |
| JP | 57-71388 | 5/1982 |
| JP | 61-15675 A2 | 1/1986 |
| WO | WO 97/04673 A1 | 2/1997 |

OTHER PUBLICATIONS

*Factors Affecting the Formation of Pyrazine Compounds in Sugar–Amine Reactions*, P.E. Koehler et el., J. Agr. Food chem., vol. 18, No. 5, 1970, pp. 895–898.

*Formation of Pyrazine Compounds in Sugar–Amino Acid Model Systems*, P. E. Koehler et al., J. Agr. Food Chem., vol. 17, No. 2, Mar–Apr. 1969, pp. 393–396.

*Mutarotation, Hydrolysis, and Rearrangement Reactions of Glycosylamines*, H. S. Isbell et al., The Journal of Organic Chemistry, vol. 23, No. 8, 1958, pp. 1309–1319.

(List continued on next page.)

*Primary Examiner*—Steven P. Griffin
*Assistant Examiner*—Carlos Lopez
(74) *Attorney, Agent, or Firm*—Alston & Bird LLP

(57) ABSTRACT

Processes for producing flavorful and aromatic compounds from flue-cured tobacco material are provided. The processes involve providing a tobacco suspension comprising finely ground flue-cured tobacco material in intimate contact with ammonia, and subjecting the tobacco suspension to heat treatment for a time and under conditions sufficient to generate a flavorful and aromatic composition. The composition can be applied to smoking articles such as cigarettes to improve the flavor and aroma character thereof.

20 Claims, No Drawings

OTHER PUBLICATIONS

*Parameter Effects on the Thermal Reaction of Cystine and 2.5–Dimethyl–4hydroxy–3(2H)–Furanone*, C., Shu et al., Chap. 21, Thermal Generation of Aromas, 1989 American Chemical Society, pp. 229–241.

*Pyrazine Formation From Serine and Threonine*, C. Shu, J. Agric. Food Chem., vol. 4A, No. 10, 1999, pp. 4332–4335.

*Studies of the Aroma of Roaasted Coffe*, W. Grosch et al., Thermally Generated Flavour, Flavour Science: Recent Developments, pp. 200–205.

The Design of Cigarettes, C. L. Browne, 1979, pp. 17–24, 56.

*The Reaction of Glucose with Some Amines*, E. Mitts et al., Journal of the American Chemical Society, vol. 66, No. 2, 1944, pp. 483–487.

*The Variety of Odors Produced in Maillard Model Systems and How They Are Influenced by Reaction Conditions*, M. J. Lane et al., Maillard Reactions, 1983 American Chemical Society, pp. 141–158.

* cited by examiner

TOBACCO-BASED COOKED CASING FORMULATION

FIELD OF THE INVENTION

The present invention relates to smoking articles such as cigarettes, and in particular to processes for providing a flavorful and aromatic composition for tobaccos.

BACKGROUND OF THE INVENTION

Popular smoking articles, such as cigarettes, have a substantially rod shaped structure and include a charge of smokable material such as strands or shreds of tobacco (e.g., cut filler) surrounded by a paper wrapper thereby providing a so-called "tobacco rod." Numerous popular cigarettes have cylindrical filter elements aligned in an end-to-end relationship with the tobacco rod. Typically, filter elements are constructed from fibrous materials such as cellulose acetate, have a circumscribing plug wrap, and are attached to the tobacco rod using tipping material.

Many types of smoking products and improved smoking articles have been proposed through the years as improvements upon, or as alternatives to, the popular smoking articles. Recently, U.S. Pat. No. 4,708,151 to Shelar; U.S. Pat. No. 4,714,082 to Baneijee et al.; U.S. Pat. No. 4,756,318 to Clearman et al.; and U.S. Pat. No. 4,793,365 to Sensabaugh, Jr. et al.; and European Patent Publication Nos. 212,234 and 277,519 propose cigarettes and pipes which comprise a fuel element, an aerosol generating means physically separate from the fuel element, and a separate mouthend piece. Such types of smoking articles provide natural tobacco flavors to the smoker thereof by heating, rather than burning, tobacco in various forms.

Generally, natural tobacco flavors and aromas are important for the taste, aroma, and acceptance of smoking products, including substitute smoking materials. Thus, the search for natural tobacco flavor additives or flavor substances is a continuing task.

To improve the flavor and aroma in smoking articles, various natural extracts prepared, e.g., from tobacco, have been included in smoking articles. For example, U.S. Patent No. 3,424,171 describes a process for the production of a non-tobacco smokable product having a tobacco taste. Tobacco is subjected to a moderate (i.e. below scorching) heat treatment, i.e., at from about 175° C. to 200° C. (350° to 400° F.), to drive off aromatic components. These components are trapped on adsorbent charcoal, and removed from the charcoal by solvent extraction.

Similarly, U.S. Pat. No. 4,150,677 describes a process for the treatment of tobacco which comprises the steps of: (1) contacting tobacco which contains relatively high quantities of desirable flavorants with a stream of non-reactive gas, under conditions whereby the tobacco is heated in a temperature range from about 140° to 180° C.; (2) condensing the volatile constituents of the resulting gaseous stream; and (3) collecting said condensate. The condensate may be used subsequently to flavor a smoking material in order to enhance the organoleptic qualities of its smoke.

British Patent No. 1,383,029 describes a method of obtaining tobacco aroma substances which comprises an extraction treatment wherein the components of the tobacco that are soluble in a suitable solvent are extracted and the residue obtained after removing the solvent is subjected to heat treatment at a temperature from 30° to 260° C.

U.S. Pat. No. 5,038,802 to White et al. and U.S. Pat. No. 5,016,654 to Bemasek et al. disclose extraction processes which heat tobacco and then pass an inert atmosphere through the heating chamber to collect volatiles from the tobacco. The volatiles are then fractionated in downstream operations, which include liquid sorbents, cold temperature traps, and filters.

U.S. Pat. No. 5,235,992 to Sensabaugh proposes a process that involves heating tobacco (e.g., in a flowing gas stream) during a first staged heating to a first "toasting" temperature to drive off volatile materials, increasing the toasting temperature during a second staged heating, and separately collecting, as flavor substances, at least portions of the volatile materials driven off at the first and second toasting temperatures.

U.S. Pat. No. 5,121,757 to White et al. proposes a process for altering the chemical nature of a tobacco extract, in which tobacco material is extracted with a chemical solvent, the extract is contacted with an ammonia compound, and the ammonia-treated extract is subjected to heat treatment in a pressure-controlled environment (e.g., in a Parr bomb).

Other processes for producing and using tobacco extracts, aroma oils and concentrates are proposed in U.S. Pat. No. 3,136,321 to Davis; U.S. Pat. No. 3,316,919 to Green; U.S. Pat. No. 3,424,171 to Rooker; U.S. Pat. No. 4,421,126 to Gellatly and U.S. Pat. No. 4,506,682 to Mueller and European Patent Publication No. 338,831 to Clapp et al.

It has also been proposed to treat tobacco to improve the flavorful and aromatic characteristics in situ. The treated tobacco with improved flavor and aroma is used in making smoking articles such as cigarettes. For example, in the method disclosed in U.S. Pat. No. 4,607,646, cured tobacco, in particular bright tobacco is subjected to heat treatment in the continuing presence of ammonia for a period of ½ to 24 hours at a temperature of 80° C. to 150° C. in a closed system. The resultant tobacco is described as having Burley-like flavor characters.

U.S. Pat. No. 4,677,994 proposes a process of forming favorable flavor compounds in a moisturized tobacco. Tobacco lamina applied with ammonium hydroxide is treated in pressurized steam and then discharged into a zone of lower pressure to expand the tobacco. Improvements in flavor and reduced irritation are observed in the resultant tobacco.

In addition, others have proposed to react non-tobacco materials to produce flavorful and aromatic compounds for use in smoking articles. For example, U.S. Pat. No. 5,413,122 to Shu issued on May 9, 1995 discloses making a flavorful and aromatic composition from β-hydroxy amino acids by contacting the amino acids with a liquid having an aqueous character followed by heat treatment in an enclosed environment to provide an aqueous solution of volatile pyrazine flavorants. The ratio of liquid to amino acid is 4:1 to 40:1. The resulting aqueous extract containing flavorful pyrazines is then applied to smoking materials to provide flavor and aroma in the smoking articles.

U.S. Pat. No. 3,478,015 discloses heating an amino acid and a sugar in the presence of a polyhydric alcohol and using the reaction product as a flavoring material.

U.S. Pat. No. 3,920,026 describes reacting the amino acid valine with a sugar, other hydroxycarbonyl compound, or dicarbonyl compound under heat treatment in a solvent such as glycerol or propylene glycol and at a temperature of about 100° C. to about 200° C. for about 0.5 to 5 hours. Optionally, a catalyst such as a flavanoid or hydroxyacid is included in the reaction. The reaction products can be used as flavorants in tobacco compositions.

U.S. Pat. No. 4,306,577 discloses the production of flavorants for smoking compositions by reacting reducing sugars and selected amino acids in the presence of ammonium hydroxide and optionally in the presence of an aldehyde in an essentially solvent-free system at a temperature range of 90° C. to 115° C. The selected amino acids are those that have at least two nitrogens such as glutamine, asparagine, lysine, and arginine.

Similarly, U.S. Pat. No. Re. 32,095 discloses reacting a reducing sugar with a source of ammonia in the presence of a trace amount of certain amino acids at a temperature in the range of about 90° C. to about 115° C. for about 5 to 15 minutes. The trace amino acids include aspartic acid, glutamic acid, asparagine, and glutamine. The weight ratio of sugar to amino acid is in the range of 200–300:1, and the weight ratio of sugar to ammonia source is about 5–15:1.

While these processes have produced flavor substances acceptable for use in many smoking articles, they have not been suitable for some smoking articles, or have required costly or time consuming steps such as forming a tobacco extract prior to the obtaining of the desired compounds, or have subjected tobacco materials to some extreme conditions before incorporating them into smoking articles. Additionally, many of these processes have necessarily required expensive or inabundant starting materials.

SUMMARY OF THE INVENTION

The present invention generally relates to a process for the production of natural tobacco flavor substances useful in tobacco smoking products as flavorants, and in tobacco substitute materials as a source of tobacco smoke flavor and/or aroma. The process of this invention produces suspensions having a complex mixture of volatile, semi-volatile, and non-volatile aroma/flavor components that are products of the Maillard reactions.

In accordance with a first aspect of this invention, flue-cured tobacco material is contacted with an aqueous liquid to form a tobacco suspension. Ammonia is provided in the tobacco suspension under conditions such that the ammonia is in intimate contact with the flue-cured tobacco material in the suspension. The tobacco suspension is subject to heat treatment for a time and under conditions sufficient to provide a flavorful and aromatic composition, which can be applied to tobacco material as a casing or top dressing ingredient.

In a preferred embodiment, tobacco in the form of finely divided particles (finely ground tobacco material) is produced from flue-cured tobacco material and is mixed with an aqueous liquid and ammonia to produce the tobacco suspension. This suspension is subjected to heat treatment in a closed pressure controlled environment (e.g., a Parr bomb) under conditions sufficient to produce the flavorful and aromatic composition. In general, the treatment temperature and time are selected such that the tobacco suspension is exposed to a temperature sufficiently high and for a period of time sufficiently long so as to provide an increase in aroma/flavor compounds. However, it is preferable that the tobacco suspension not be exposed to such a high temperature for a sufficiently long period of time so as to provide an aroma/flavor which exhibits a burnt or tarry aroma/flavor. Thus, for the purposes of this invention, it is convenient to refer to the heat treatment, or the moderately high temperature treatment, of a tobacco suspension.

The tobacco suspension comprising flue-cured tobacco material and ammonia should have sufficient aqueous liquid such that a liquid phase is present in the suspension. Typically the tobacco suspension can include solids in an amount of about 80% by weight or less. More preferably, the suspension contains less than 75% by weight, even more preferably less than 50% by weight solids, and most preferably contains between 10% and 25% by weight solids. For the purposes of this invention, a tobacco suspension can include tobacco material in a dust or powder form, together with ammonia, and the aqueous liquid can further include additives including amino acids, amino acid analogs or amino acid sources or other nitrogen sources, and/or sugar (or sugar sources). Preferred amino acids include threonine, serine, leucine, isolecine, and valine.

The ammonia can be provided in the suspension via anhydrous ammonia in a gaseous form (e.g., ammonia gas) or via aqueous ammonia (e.g., ammonia hydroxide). Preferably, the ammonia is aqueous ammonium hydroxide, i.e., by dissolving ammonia gas or concentrated ammonium hydroxide in the aqueous liquid.

Typically, the tobacco suspension is subjected to heat treatment at a temperature significantly above about 95° C. in a pressure controlled and generally inert environment. In particular, it has been found that the amount of aromatic flavorants generated in the present invention is significantly increased when the temperature of the heat treatment is increased to above 95° C. Preferably the heat treatment is conducted at a temperature of above 100° C., more preferably at least about 120° C., and most preferably at least about 145° C. It has been discovered that the pyrazine yield is particularly high when the temperature for heat treatment is 120° C. or greater.

The heat treatment step of the present invention can be conducted in the presence of inert gas or ambient air, and additional oxygen or an equivalent oxidizing agent are not required. In general, the pressure experienced by the tobacco suspension is greater than ambient (i.e., atmospheric) pressure. Typical pressures experienced by the tobacco suspension during the process of the present invention in an enclosed vessel range from about 10 psig to about 1,000 psig, normally from about 20 psig to about 500 psig, preferably about 20 psig to about 100 psig.

The resultant flavorful and aromatic compositions are useful as casing or top dressing components for tobacco laminae and cut filler, as well as for other smokable materials. Alternatively, such flavorful and aromatic compositions are useful in those types of smoking articles described in U.S. Pat. No. 4,708,151 to Shelar; U.S. Pat. No. 4,714,082 to Banerjee et al.; U.S. Pat. No. 4,756,318 to Clearman et al.; and U.S. Pat. No. 4,793,365 to Sensabaugh; as well as European Patent Publication Nos. 212,234 and 277,519.

The flavorful and aromatic compositions are also useful as cigarette filter additives. For example, the flavorful and aromatic compositions can be incorporated into low density polyethylenes and formed into strands, and then incorporated into cigarette filters as described in U.S. Pat. No. 4,281,671 to Byrne et al. and U.S. Pat. No. 4,862,905 to Green, Jr. et al. The flavorful and aromatic compositions are also useful as cigarette wrapper additives; or as additives to the inner regions of cigarette packages (e.g. within a paper/foil laminate of a cigarette package or within a low density polyethylene film which is placed within a cigarette package) in order to provide a desirable cigarette aroma and "pack aroma."

Flavor compounds produced by the methods of the present invention have organoleptic qualities and volatile content qualities that are comparable to those compounds produced by solvent extraction of natural compounds and heat treatments thereof, and those compounds generated based on conventional cooked casing formulations.

In contrast to other cooked-casing formulations which typically require use of substantial amounts of reducing sugars along with a nitrogen source, the method of the present invention does not require reducing sugars in the tobacco suspension. Nevertheless, the heat treatment of the tobacco suspension generates flavorful and aromatic compounds in an amount and quality comparable to those produced in conventional formulations.

Additionally, it has been found that tobacco materials formerly discarded as waste products of the manufacturing process may be used as starting materials in the process of the present invention to yield flavorful aromatic substances that are comparative in concentration of desirable organoleptic components to conventional tobaccos. Tobacco dust represents a significant portion of tobacco material lost during the manufacture of cigarettes. Thus, the present invention provides a simple, inexpensive and efficient method for producing aroma and flavor components for the manufacture of smoking articles and the like while also reducing waste in the manufacturing process.

These and other advantages of the present invention are more completely illustrated the following detailed description of the preferred embodiments of the invention and the accompanying examples.

DETAILED DESCRIPTION OF THE PREFERRED EMBODIMENTS

In accordance with the present invention, a tobacco suspension comprising flue-cured tobacco material in intimate contact with ammonia is subjected to heat treatment for a time and under conditions sufficient to generate a flavorful and aromatic composition. The composition can be applied to smoking articles such as cigarettes to improve the flavor and aroma character thereof.

Flue-cured tobacco is generally known in the art and refers to a class of tobaccos grown, harvested and processed by particular methods known in the art. See generally Browne, *The Design of Cigarettes*. Bright tobacco and Virginia tobacco are commonly used flue-cured tobaccos in the U.S. Typically, flue-cured tobaccos are processed by "flue-curing" or similar methods, and have a high sugar content while their nitrogen content is relatively low. It is to be understood that, as used herein, the term "flue-cured tobacco" is inclusive and includes tobaccos that are not strictly classified as flue-cured tobacco but nevertheless have chemistry profiles, in particular, sugar and nitrogen content profiles, similar to those of typical flue-cured tobacco. Normally, the "flue-cured tobacco" used in the present invention has a reducing sugars (calculated as dextrose) content of at least about 2%, preferably at least about 5%, more preferably at least about 10% by weight based on the total dry tobacco weight. Advantageously, the total reducing sugars content (calculated as dextrose) is 15% or greater based on the total dry weight of tobacco.

Other types of tobacco can also be included, in addition to "flue-cured tobacco," in the tobacco suspension of the present invention. Examples of such other tobacco types include, but are not limited to, air-cured tobacco including Burley and Maryland tobaccos, sun-cured tobacco such as Oriental tobacco, and Turkish, Latakia, as well as the rare or specialty tobaccos, or blends thereof. Unaged, uncured, mature or immature tobaccos, or blends thereof may also be employed. However, advantageously at least about 20% by weight of the total tobacco content is flue cured tobacco; preferably at least about 50%, more preferably at least about 70%, and most preferably at least about 80% of the total tobacco is flue cured tobacco. As flue-cured tobacco generates the most desirable results in the process of the invention, it is advantageous that a substantial portion, e.g., at least 90%, of the total tobacco content is flue-cured tobacco. Preferably, 100% of the total tobacco content is flue-cured tobacco.

The tobacco material in the tobacco suspension can be in various forms, e.g., leaves, stems, strips, cut fillers, shreds, etc. Tobacco waste materials such as fines, dust, scrap, stem, and stalk can be employed. In one preferred embodiment of the present invention, the tobacco material comprises a cigarette manufacturing by-product known to the skilled practitioner as "tobacco dust."

Preferably, the tobacco material is in the form of finely divided particles. The aforementioned tobacco material can be subjected to various means to reduce its size, such as grinding, such that the resulting tobacco material is in finely ground tobacco material dust or powder. Various grinding techniques will be apparent to one skilled in the art, and may include the use of, e.g., ball mills or hammer mills. The grinding may also be carried out under vibrating or agitating conditions, the selection of said conditions being within the skill of one in the art. As used herein, the term "finely tobacco ground material" refers to tobacco materials composed of particles that are less than 10 mesh, preferably less than 20 mesh, and most preferably are less than 40 mesh (standard sieve size). That is, the fine particles most preferably can pass a 40 mesh (Tyler) screen. Alternatively, the tobacco material may already be in dust form such that additional grinding is not necessary (i.e., the starting tobacco material is already finely divided).

The tobacco suspension typically is provided by contacting tobacco material including flue-cured tobacco material with ammonia and sufficient liquid such that a liquid phase is present in the suspension. The liquid is primarily of an aqueous character and contains primarily of water. Ammonia can be introduced into the tobacco suspension in various forms. Ammonia can be introduced into the aqueous liquid prior to or after the tobacco material is contacted with the liquid. For example, ammonia in a gaseous form can be conveniently injected into or bubbled through the aqueous liquid or suspension. Alternatively, a concentrated ammonium hydroxide solution can be diluted into the aqueous liquid or suspension. Typically, the ammonia hydroxide concentration in the tobacco suspension is at least about 10 mM, preferably at least about 50 MM, more preferably at least about 0.1 M, and most preferably at least about 0.5 M. Normally, the ammonium hydroxide concentration in the tobacco suspension is not greater than 5 M, although a higher concentration may also be effective. Advantageously the ammonia hydroxide concentration is from about 0.5 M to about 2 M.

The aqueous liquid normally contains greater than about 90 weight percent water, and can be essentially pure water in certain circumstances. For example, a liquid having an aqueous character can be distilled water, tap water, or the like. However, a liquid having an aqueous character can include water having substances such as pH buffers, organic and inorganic acids, bases and salts, or surfactants incorporated therein, or minor amounts of one or more organic solvents (e.g., various alcohols, polyols or humectants such as glycerin or polypropylene glycol).

In the tobacco suspension, the tobacco content can vary. Typically, the content of flue-cured tobacco may be at least about 5 percent of the total suspension by weight, preferably at least about 10 percent by weight, and more preferably at least about 25 percent by weight. The tobacco suspension can have 80% by weight or less solids, more preferably less than about 50% by weight solids.

The tobacco suspension can also include an exogenous reducing sugar or reducing sugar source. The tobacco suspension may have a reducing sugar content of from 0% by weight to up to about 15%, although a higher concentration may also be used. As is known in the art, tobacco materials including flue-cured tobaccos typically contain a certain amount of reducing sugars or compounds such as disaccharides and polysaccharides which can release reducing sugars therefrom. As used herein, the term "exogenous reducing sugar or reducing sugar source" means reducing sugar or reducing sugar source that is not contained in or derived from the tobacco materials in the tobacco suspension, i.e., they are exogenous to the tobacco materials.

Suitable reducing sugars that can be used in the invention include, but are not limited to, glucose, fructose, sucrose, mannose, galactose, rhanmose, and mixtures thereof The reducing sugar can be in a pure form or in unrefined form, e.g., high fructose corn syrup (HFCS) which has a high content of fructose. Many derivatives of reducing sugars can also be used, e.g., phosphate-substituted reducing sugars (e.g., glucose-6-phosphate, fructose-6-phosphate, and fructose-1,6-diphosphate). Reducing sugars can also be provided in the form of precursors that can readily release reducing sugars under the reaction conditions employed in the method of this invention. Examples of suitable precursors can include disaccharides and polysacchrides, and derivatives thereof. In such cases, reducing sugars can be generated by the hydrolysis of disaccharides or polysaccharides. In a preferred embodiment of the invention, a high fructose corn syrup (HFCS) having at least about 30% by weight of fructose is used as the reducing sugar component. For example, a high fructose corn syrup having about 42% by weight of fructose is commercially available from Corn Products International, Bedford Park, Ill.

Additionally, although not required, the tobacco suspension can optionally include one or more exogenous amino acids, amino acid source, or amino acid analog. Again, the term "exogenous" is used herein to mean additional amino acids or amino acid sources exogenous to the tobacco materials in the tobacco suspension. Threonine, serine, leucine, isoleucine, and valine are the preferred amino acids.

If desired, flavoring agents, e.g., cocoa, licorice, St. John's bread, spices, herbs, and the like can also be added to the tobacco suspension. Base materials, particularly ammonium salts of inorganic acids such as ammonium orthophosphate, ammonium dihydrogen orthophosphate, diammonium monohydrogen orthophosphate, and the like may also be included.

The tobacco suspension is subjected to a heat treatment such as generally described in U.S. Pat. No. 5,060,669 to White et al., the disclosure of which is incorporated herein by reference in its entirety. The heat treatment can be conducted at a temperature of at least about 95° C., preferably at least about 110° C., more preferably at least about 135° C., and most preferably at least about 145° C. Advantageously, the heat treatment can be conducted at a temperature of 155° C. or greater. However, it is desirable to subject the tobacco suspension to a temperature below about 250° C., more desirably below about 200° C., in order to avoid an undesirable formation of components which are deleterious to the taste characteristics of the tobacco composition.

The moderately high temperature treatment is performed in a pressure controlled environment. Such an environment is provided by enclosing the tobacco suspension in an air sealed vessel or chamber. Typically, a pressure controlled environment is provided using a pressure vessel or chamber which is capable of withstanding relatively high pressures. Such vessels or chambers (i) provide enclosure or concealment of the tobacco suspension such that ammonia is contained and in intimate contact with the tobacco materials in the suspension during the heat treatment, (ii) provide enclosure of the tobacco suspension such that volatile flavor components generated during the heat treatment are not lost or do not otherwise escape during the moderately high temperature treatment step, and (iii) provide for treatment of the tobacco suspension at a temperature above about 95° C. Preferred pressure vessels are equipped with an external heating source. Examples of vessels which provide a pressure controlled environment include a high pressure autoclave from Berghof/America Inc. of Concord, Calif., and Parr Reactor Model Nos. 4522 and 4552 available from The Parr Instrument Co. and described in U.S. Pat. No. 4,882,128 to Hukvari et al. Operation of such exemplary vessels will be apparent to the skilled artisan. Typical pressures experienced by the tobacco suspension during the process of the present invention in such vessels range from about 10 psig to about 1,000 psig, normally from about 20 psig to about 500 psig, preferably about 20 psig to about 100 psig.

The amount of time that the tobacco suspension is subjected to the moderately high temperature treatment can vary. Normally, the time period is sufficient to heat an entire tobacco suspension at the desired temperature for a period of at least about 10 minutes, preferably at least about 20 minutes. Typically, when the heat treatment is conducted at a higher temperature, less time is required for the heat treatment. It is desirable to control the time/temperature profile of tobacco suspensions subjected to heat treatment so that each tobacco suspension is not subjected to a particularly high temperature for a lengthy period of time. Although a longer time period may be used for the heat treatment, typically, the time period is less than about 3 hours, preferably no greater than about 1 hour. Some minor degree of experimentation may be required to determine the optimal time period at a particular heat treatment temperature, this being well within the capability of one skilled in the art once apprised of the present disclosure.

It is highly desirable to employ a pressure vessel design or a vessel equipped with an agitation mechanism such that the tobacco suspension experiences a relatively uniform temperature throughout the treatment period. In particular, it is highly desirable for the entire tobacco suspension to be heated uniformly throughout as much as possible at the maximum temperature to which the tobacco suspension is subjected.

Conditions provided during the process of the present invention most desirably are such that certain components of the tobacco suspension (e.g., naturally occurring sugars and ammonium) undergo the Maillard Reactions or "browning reactions" to form flavorful and aromatic compounds including pyrazines. The Maillard Reactions are reactions between (i) ammonium or the amino substituent of amino acids, peptides, proteins or other nitrogen-containing compounds, and (ii) the carbonyl group of a sugar in the reducing form or other carboxyl-containing compounds which are endogenous or added to the tobacco suspension. Such reactions result in a significant darkening of the tobacco suspension, typically to an extremely dark brown color. See e.g., Maillard, *Ana Chim.*, Vol. 9, pp. 5 and 258 (1916); Hodge, *J. Agric. Food Chem.*, Vol. 1, p. 928 (1953); Nursten, *Food Chem.*, Vol. 6, p. 263 (1981) and Waller et al, *ACS Symp. Ser.* (1983).

The resultant composition after the heat treatment contains flavorful and aromatic compounds and is useful as flavorant material in the manufacture of smoking articles. When the tobacco suspension subjected to heat treatment contains tobacco materials that are in strips, stems, leaves, and the like and are not in finely ground particle forms, the heat treated tobacco suspension can be subjected to any various size reduction processes to reduce the tobacco materials to fine particles and to form a slurry. The resultant slurry can be incorporated into smoking articles during the manufacturing .process as a top dressing or casing ingredient, or in any convenient mode selected by the manufacturer. Similarly, when the tobacco materials in the tobacco suspension are in a fine particle form, the slurry formed after the heat treatment can be applied directly to and/or incorporated directly into smoking articles in the form of, e.g., casing or top dressing material. Alternatively, the solid materials can be separated from the aqueous liquid by any suitable means and the liquid component of the treated tobacco suspension can be applied, e.g., as casing or top dressing ingredients, to tobacco material such as tobacco lamina or cut filler. The tobacco material can be natural tobacco, or prepared from reconstituted or substituted tobaccos.

The amount of the treated tobacco suspension employed per cigarette or smoking article can vary. For example, in a typical cigarette having about 0.6 to about 1 g per rod of smokable material, about 0.1 to 10% by weight, preferably about 0.5 to 6% by weight, more preferably about 1 to 2.5% by weight of the heat treated suspension based on the total weight of the smokable material in the smoking article, either in the form of slurry, or liquid or solids, can be used as a top dressing or casing.

Moreover, the treated tobacco suspension may be used as a filter flavor material for a cigarette. The suspension may be used to provide flavor/aroma to any of the forms of material that are used in the manufacture of tobacco products such as cigars, cigarettes, smoking tobacco or snuffs.

The present invention is more fully illustrated by the following examples, which are set forth to illustrate the present invention and are not to be construed as limiting thereof In the following examples, mg means milligram, μg means micrograms, g means grams, L means liters, mL means milliliters, min means minutes, and mm means millimeters.

In the following examples, unless otherwise specified, the amino acids were obtained from Aldrich Chemical Company and used as received. HFCS was obtained from Corn Products International Inc.

For heat treatment, each mixture was enclosed in a microwave permeable reaction vessel, CEM Corporation, Model #XP-1500 or HP-500. Heat treatment was 10 conducted in a microwave oven of CEM Corporation, Model MES-1000 under the conditions described in Table 1.

TABLE 1

| Microwave Oven Operating Parameters | |
|---|---|
| System | CEM Model MES-1000 |
| Sample Temperature | 105–125° C. |
| Sample Temperature Ramp Time | 10 min |
| Microwave power | 950 ± 50 watts |
| Microwave Frequency | 2450 MHz |
| Sample Heating Time | 60 min |
| Ramp Time to Heating Temperature | 10 min |

After heat treatment, headspace analysis was conducted in a method similar to that reported in Coleman et al., *J. Chrom. Sci.* 32:323 (1994). For each sample 1.0 mL was placed in a 5 mL sparge tube along with 1 mL of an aqueous standard containing 21.8 mg/L cyclohexanone as an internal standard. The yield of volatiles was calculated based on the response of cyclohexanone. The headspace sampling parameters listed in Table 2 below were applied in the analysis of each sample.

TABLE 2

| Headspace-GC-MDS Operating Conditions | |
|---|---|
| System Configuration | Hewlett Packard (HP) 5880 GC equipped with a 5970 MSD and a Tekmar 2000LSC Autosampler |
| Column | DB-1701, 30 meters, 0.32 mm I.D. 1 μm film thickness |
| Injection Port temperature | 250° C. |
| Injection | Splitless |
| Inlet Pressure | ~20 psi |
| Column Oven Initial Temperature | 10° C. |
| Column Oven Initial Time | 0 min |
| Column Oven Initial Ramp 1 Rate | 2.5° C./min |
| Column Oven 1 Final Temperature | 47° C. |
| Column Oven Ramp 2 Rate | 10° C./min |
| Column Oven 2 Final Temperature | 230° C. |
| Column Oven 2 Final Time | 20 min |
| Sample Purge Time | 20 min |
| Sample Pre-heat Time | 5 min |
| Sample Desorb Time | 5 min |
| Sample Desorb Temperature | 180° C. |
| Sample Purge Temperature | 70° C. |
| Mass Spectrometer Transfer Line Temp | 250° C. |
| Mass Spectrometer Configuration | Electron Impact, 70 eV |

COMPARATIVE EXAMPLE I

Heat Treatment of Burley and/or Flue-Cured Tobacco Suspensions

A series of tobacco suspension was prepared by suspending 5 grams of freshly ground tobacco material in water such that the final total volume was 30 ml. The tobacco material was either Burley or Flue-cured tobacco or a mixture of the two types at a predetermined ratio. After heat treatment at various temperatures, the yield of headspace pyrazines was determined for each sample suspension. The results are shown in Table 3.

TABLE 3

Heat Treatment of Burley and/or Flue-cured Tobacco

| Temperature | Headspace Pyrazines (μg/ml) Burley/Flue-Cured Ratio | | | | | | |
|---|---|---|---|---|---|---|---|
| (° C.) | 100/0 | 80/20 | 60/40 | 50/50 | 40/60 | 20/80 | 0/100 |
| 165 | 32.52 | 30 | 30.68 | 30.53 | | | |
| 145 | 4.12 | 4.44 | 1.98 | 2.74 | 3.81 | 1.29 | 1.98 |
| 125 | 2.48 | 1.78 | 1.92 | 1.73 | | 3.01 | 0.94 |
| 105 | 1.13 | 0.81 | 1.06 | 0.93 | 1.41 | 0.98 | 0.76 |

COMPARATIVE EXAMPLE II

Heat Treatment of Burley Tobacco Suspensions with Ammonia and Sugar

A series of Burley tobacco suspension samples were prepared by suspending 5 grams of freshly ground Burley tobacco material in water. Various amounts of HFCS and/or 30% $NH_4OH$ were added to the samples. The final volume of each sample was adjusted to 30 ml with water. After heat treatment at 105° C. or 125° C., the yield of headspace pyrazines was determined for each sample suspension. The results are shown in Tables 4 (105° C.) and 5 (125° C.).

TABLE 4

Heat Treatment of Burley Tobacco Suspensions with Ammonia and/or Sugar at 105° C.

| | Headspace Pyrazines (μg/ml) 30% $NH_4OH$ (ml) | | |
|---|---|---|---|
| HFCS (g) | 0 | 0.36 | 0.72 |
| 3.75 | 4.06 | 39.06 | 121.34 |
| 2.5 | 4.58 | 52.62 | 153.31 |
| 1.25 | 10.16 | 39.3 | 123.37 |

TABLE 5

Heat Treatment of Burley Tobacco Suspensions with Ammonia and/or Sugar at 125° C.

| | Headspace Pyrazines (μg/ml) 30% $NH_4OH$ (ml) | | |
|---|---|---|---|
| HFCS (g) | 0 | 0.36 | 0.72 |
| 3.75 | 7.29 | 39.15 | 89.79 |
| 2.5 | 57.19 | 72.68 | 190.56 |
| 1.25 | 18.61 | 42.76 | 102.49 |

COMPARATIVE EXAMPLE III

Tobacco-Free Cooked Casing

A conventional casing formulation was prepared by mixing 5.45 ml of 30% ammonium hydroxide, 12.5 g HFCS, 0.5 g valine and 0.5 g leucine with water to obtain a final volume of 30 ml. The mixture was heated in microwave oven as described above at 105° C. for 60 minutes. Headspace pyrazine yield was determined to be approximately 1000 μg/ml.

EXAMPLE I

Heat Treatment of Flue-Cured Tobacco Suspensions with Ammonia

A series of Flue-cured tobacco suspension samples were prepared by suspending 5 grams of freshly ground Flue-cured tobacco material in water. Various amounts of HFCS and/or 30% $NH_4OH$ were added to the samples. The final volume of each sample was adjusted to 30 ml with water. After heat treatment at 105° C. or 125° C., the yield of headspace pyrazines was determined for each sample suspension. The results are shown in Tables 6 (105° C.) and 7 (125° C.).

TABLE 6

Heat Treatment of Flue-cured Tobacco Suspensions with Ammonia at 105° C.

| | Headspace Pyrazines (μg/ml) $NH_4OH$ (ml) | | |
|---|---|---|---|
| HFCS, (g) | 1.82 | 3.63 | 5.45 |
| 3.75 | 305 | 663 | 942 |
| 2.5 | 323 | 59 | 911 |
| 1.25 | 198 | 426 | 666 |
| 0 | 202 | 306 | 349 |

TABLE 7

Heat Treatment of Flue-cured Tobacco Suspensions with Ammonia at 125° C.

| | Headspace Pyrazines (μg/ml) $NH_4OH$ (ml) | | |
|---|---|---|---|
| HFCS, (g) | 1.82 | 3.63 | 5.45 |
| 3.75 | 915 | 2089 | 2314 |
| 2.5 | 483 | 1120 | 1210 |
| 1.25 | 682 | 1300 | 1050 |

EXAMPLE 2

Valine and Leucine Increase the Branched Alkyl Side Chains in Pyrazines

The formulations in Example 1 were fortified with 0.5 g leucine and 0.5 g valine to test for the formation of pyrazines containing branched alkyl side chains. Examination of the headspace pyrazine profile for the flue-cured tobacco-based casing formulations revealed that the pyrazines with branched alkyl side chains comprised on the average about 6.5% and 4% of the total pyrazines for the formulations produced at 125° C. and 105° C., respectively. [In the headspace pyrazines generated in Experiment I (not fortified with amino acids), less than about 1% are pyrazines with branched alkyl side chains.] These values are slightly less than that obtained by fortifying the tobacco-free cooked casing formulations in Comparative Example III (8%), but greater than that obtained by fortifying the Burley-based casing formulations in Comparative Example II (2–3%).

In the specification and examples, there have been disclosed preferred embodiments of the invention. Although specific terms are employed in these examples, they are used in a generic and descriptive sense only and not for the purpose of limitation, the scope of the invention being defined by the following claims.

That which is claimed is:

1. A method for improving the flavor and aroma character in a smoking article comprising:

providing an aqueous tobacco suspension comprising tobacco material and ammonia, said tobacco suspension having a liquid phase, said tobacco material being flue-cured tobacco, and wherein the ammonia concentration is equivalent to at least about 0.5M ammonium hydroxide;

subjecting said tobacco suspension to heat treatment for a time and under conditions sufficient to provide a flavorful and aromatic composition; and incorporating at least a liquid portion of said flavorful and aromatic composition into a component of the smoking article.

2. The method according to claim 1, wherein said flavorful and aromatic composition is incorporated into the smoking article as a casing or top dressing material.

3. The method according to claim 1, wherein said tobacco suspension is produced by contacting said tobacco material with an aqueous liquid consisting of at least about 90% by weight water.

4. The method according to claim 1, wherein the heat treatment is conducted in a closed elevated pressure environment.

5. The process according to claim 4, wherein the tobacco suspension is subjected to heat treatment at a pressure of about 10 psig to about 1000 psig.

6. The method according to claim 1, wherein the heat treatment is conducted at a temperature of at least about 105° C.

7. The method according to claim 1, wherein the heat treatment is conducted at a temperature of at least about 120° C.

8. The method according to claim 1, wherein the tobacco suspension contains 10 percent or greater said tobacco material by weight.

9. The method according to claim 1, wherein the tobacco suspension further comprises a reducing sugar.

10. The method according to claim 9, wherein the reducing sugar is in the form of high fructose corn syrup.

11. The method according to claim 1, wherein the tobacco suspension further comprises an exogenous amino acid selected from the group consisting of serine, threonine, valine, leucine, and isoleucine.

12. The method according to claim 1, wherein the tobacco material is in the form of fine particulate.

13. A method for improving the flavor and aroma character in a smoking article comprising:

subjecting an aqueous mixture comprising finely particulate tobacco material and ammonia to heat treatment in a closed elevated pressure, environment at a temperature of at least about 120° C. for a time sufficient to provide a flavorful and aromatic composition, said tobacco material being flue-cured tobacco and said aqueous mixture forming a tobacco suspension wherein the ammonia concentration is equivalent to at least about 0.5M ammonium hydroxide; and incorporating a portion of said flavorful and aromatic composition into a smoking article containing smokable material.

14. The method of claim 13, wherein a liquid portion of said flavorful and aromatic composition is incorporated into the smoking article as a casing or top dressing material.

15. The method of claim 13, said flavorful and aromatic composition is incorporated into the smoking article as a casing or top dressing material in an amount of about 1 to 2.5% by weight based on the total weight of the smokable material in the smoking article.

16. The method of claim 13, wherein the aqueous mixture further comprises an exogenous reducing sugar.

17. The method of claim 16, wherein the reducing sugar is in the form of high fructose corn syrup.

18. The method of claim 13, wherein the aqueous mixture further comprises an exogenous amino acid selected from the group consisting of serine, threonine, valine, leucine, and isoleucine.

19. The method of claim 13, wherein said tobacco material is tobacco dust.

20. A method for producing a flavorful and aromatic composition for use in smoking articles, comprising:

providing an aqueous mixture including finely particulate flue-cured tobacco material and ammonium hydroxide, the aqueous mixture forming a tobacco suspension, and wherein ammonium hydroxide is present at a concentration of at least 0.5M; and subjecting the aqueous mixture to heat treatment in a closed elevated pressure environment at a temperature of at least about 120° C. for a time sufficient to generate Maillard Reaction products.

* * * * *

UNITED STATES PATENT AND TRADEMARK OFFICE

CERTIFICATE OF CORRECTION

PATENT NO. : 6,499,489 B1
DATED : December 31, 2002
INVENTOR(S) : Coleman, III

It is certified that error appears in the above-identified patent and that said Letters Patent is hereby corrected as shown below:

Title page,
Item [56], References Cited, OTHER PUBLICATIONS, "Parameter Effects… reference "4hydroxy" should read -- 4-hydroxy --;
"of the Aroma of Roaasted Coffe" should read -- on the Aroma of Roasted Coffee --.

Column 12,
Table 7, after Line 26, insert the following line:
-- 0 437 698 723 --.

Column 13,
Line 37, after "pressure" cancel the comma (,).

Column 14,
Line 32, after "wherein" insert -- the --.

Signed and Sealed this

Twentieth Day of May, 2003

JAMES E. ROGAN
*Director of the United States Patent and Trademark Office*